US011970831B2

(12) United States Patent
Pusat et al.

(10) Patent No.: US 11,970,831 B2
(45) Date of Patent: Apr. 30, 2024

(54) PIER HATCH CONTROL SYSTEM

(71) Applicant: Galataport Istanbul Liman Isletmeciligi Ve Yatirimlari Anonim Sirketi, Istanbul (TR)

(72) Inventors: Ali Pusat, Istanbul (TR); Figen Ayan, Istanbul (TR); Necil Adiyaman, Istanbul (TR)

( * ) Notice: Subject to any disclaimer, the term of this patent is extended or adjusted under 35 U.S.C. 154(b) by 52 days.

(21) Appl. No.: 17/272,888

(22) PCT Filed: Jul. 10, 2020

(86) PCT No.: PCT/TR2020/050617
§ 371 (c)(1),
(2) Date: Mar. 2, 2021

(87) PCT Pub. No.: WO2021/177916
PCT Pub. Date: Sep. 10, 2021

(65) Prior Publication Data

US 2022/0127815 A1 Apr. 28, 2022

(30) Foreign Application Priority Data

Mar. 6, 2020 (TR) ..... 2020/03467

(51) Int. Cl.
*E02D 29/14* (2006.01)
*E01F 13/08* (2006.01)

(52) U.S. Cl.
CPC ..... *E02D 29/1418* (2013.01); *E01F 13/08* (2013.01)

(58) Field of Classification Search
CPC ..... E02D 29/1418; E01F 13/08
USPC ..... 52/74
See application file for complete search history.

(56) References Cited

U.S. PATENT DOCUMENTS

2006/0026902 A1* 2/2006 McKernen ..... E02D 29/1418 49/340
2015/0156984 A1* 6/2015 Anderson ..... E01F 13/126 256/73

FOREIGN PATENT DOCUMENTS

CN 208950451 U 6/2019
ES 2112138 A1 3/1998

OTHER PUBLICATIONS

International Search Report for corresponding PCT/TR2020/050617, dated Nov. 27, 2020.

(Continued)

*Primary Examiner* — Mark R Wendell
(74) *Attorney, Agent, or Firm* — Egbert, McDaniel & Swartz, PLLC

(57) ABSTRACT

A hatch control system providing creation of temporary bonded zones and ISPS (International Port Plants and Vessel security) area meeting legislations in order to build a barrier from the ground used in broad areas accessible by public and particularly in cruise ports. The system includes a hatch containing concrete coating having steel construction profiles thereon and located in parallel to the ground thus raising upward from one surface on ground and opening-closing vertically, an actuator connected to inside of the cover and providing opening-closing of the cover by rotation motion, a hydraulic power unit connected to the actuator and providing power transmission to the actuators, a control center connected to hydraulic power unit and sending command to the hydraulic power unit to provide opening-closing of the hatches.

4 Claims, 2 Drawing Sheets

(56) References Cited

OTHER PUBLICATIONS

Written Opinion of the International Searching Authority for corresponding PCT/TR2020/050617, dated Nov. 27, 2020.

* cited by examiner

PIER HATCH CONTROL SYSTEM

TECHNICAL FIELD

The invention relates to hatches and control system to be used in areas subject to customs legislations.

The invention particularly relates to the hatches and control system, which allows the creation of a temporary bonded zones and ISPS (International Ship and Port Facility Security) area with properties that comply legal regulations by rising above from ground in public areas.

STATE OF THE ART

The port areas, which are closed to the public and can only be entered with special permissions, are isolated by the wires and barbed wires laid on them in accordance with the legislation, ensuring field safety and used in the status of bonded space.

In the related art, entry is not allowed except for personnel/visitors who have been authorized and/or received entry permits to the areas used in the status of bonded area. Therefore, these isolated areas are not open to city users under any circumstances, and these large areas do not benefit the public interest. This situation has led to the need for systems to make it possible to use the areas used in the status of bonded areas for public benefit in cities that have grown and expanded as a result of increased population and unplanned construction.

As a result, the existence of the above problems and the lack of existing solutions made it necessary to make a development in the related art.

PURPOSE OF THE INVENTION

This present invention relates to a hatch and control system eliminating above mentioned disadvantages and providing new advantages in the related art.

The main purpose of the invention is to create a bonded area and ISPS (International Ship and Port Facility Security) area with usable properties in accordance with the legal regulations by creating barrier by rising from the ground in large public areas.

The purpose of the invention is to provide creation of temporary bonded area in broad areas, especially in cruise ports.

Another purpose of the invention is to create flexibility in port activities for high capacity cruise ports.

In order to achieve purposes described above and given under detailed description, the invention relates to hatches used in broad areas accessible to public and particularly in cruise ports, and control system thereof characterized by comprising

- A cover consist of concrete coating having steel construction profiles thereon and located in parallel to the ground thus raising upward from one surface on ground and opening-closing vertically,
- An actuator connected to inside of the cover and providing opening-closing of the cover by means of rotation motion,
- A hydraulic power unit connected to the actuator and providing power transmission to the actuators,
- A control center connected to hydraulic power unit and sending command to the hydraulic power unit to provide opening-closing of the covers.

The structural and characteristic features of the present invention will be understood clearly by the following drawings and the detailed description made with reference to these drawings. Therefore, the evaluation shall be made by taking these figures and the detailed description into consideration.

DESCRIPTION OF PART REFERENCES

Figure 1:
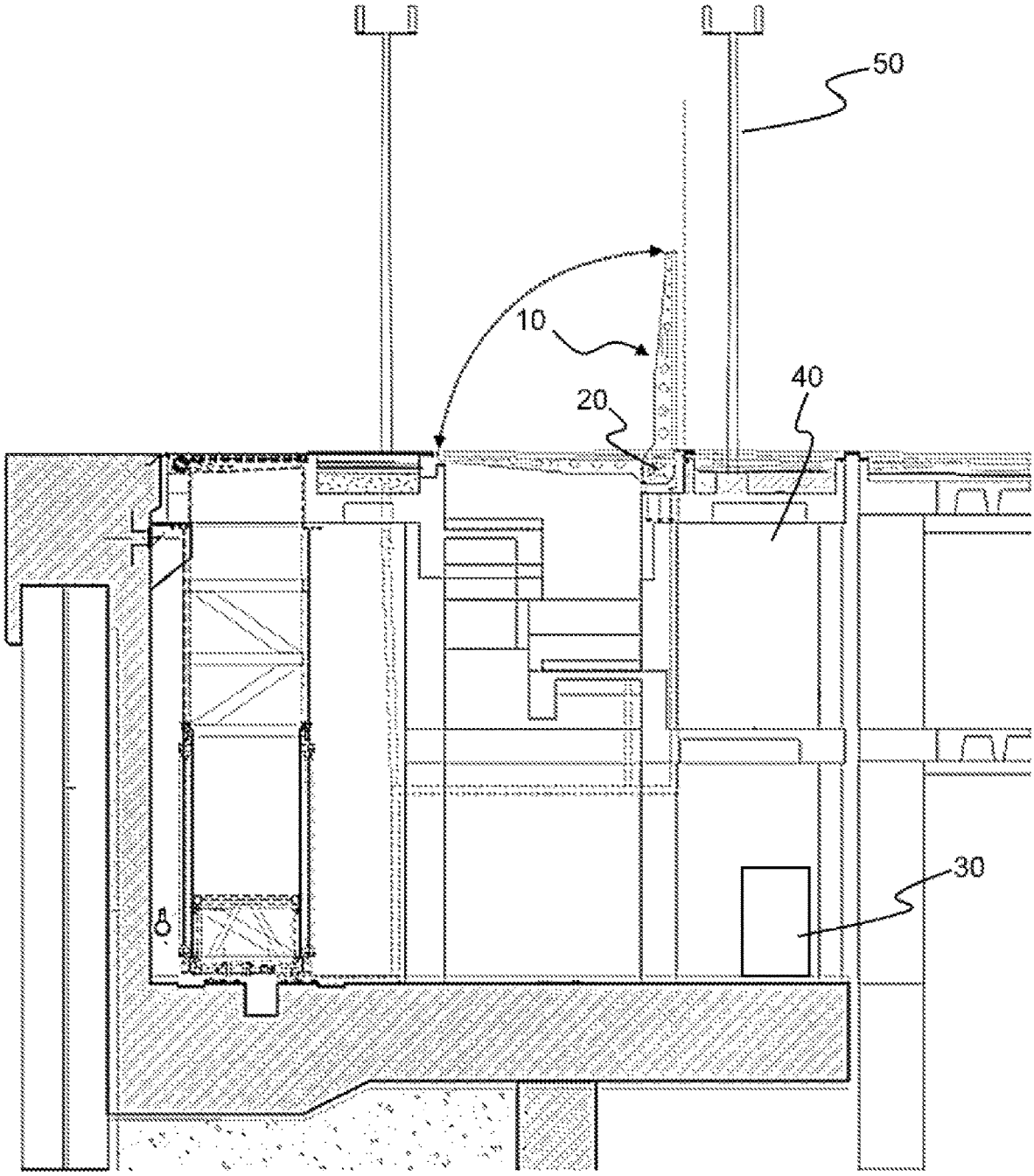
FIG. 1 is an illustrative view of hatch control system of the invention.

10. Hatch
11. Steel construction
12. Concrete coating
13. Glass hole
20. Actuator
30. Hydraulic power unit
40. Control center
50. Security pole

DETAILED DESCRIPTION OF THE INVENTION

In this detailed description, the preferred alternatives of hatch control system being subject of the invention have been described in a manner not forming any restrictive effect and only for purpose of better understanding of the matter.

FIG. 1 shows illustrative view of hatch control system of the invention. According to FIG. 1, the hatch control system in its most fundamental form comprises a cover (10) containing concrete coating (12) having steel construction profiles (11) thereon and located in parallel to the ground thus raising upward from one surface on the ground and opening-closing vertically, an actuator (20) connected to inside of cover (10) and providing opening-closing of cover (10) by means of rotation motion, a hydraulic power unit (30) connected to the actuator (20) and providing hydraulic power transmission to the actuators (20), a control center (40) connected to hydraulic power unit (30) and sending command to hydraulic power unit (30) to provide opening-closing of covers (10), security pole (50) located in the surrounding of the cover (10) and equipped with thermal or normal camera and illumination units providing surrounding security during opening of covers (10) by raising from ground to create barrier.

Figure 2:
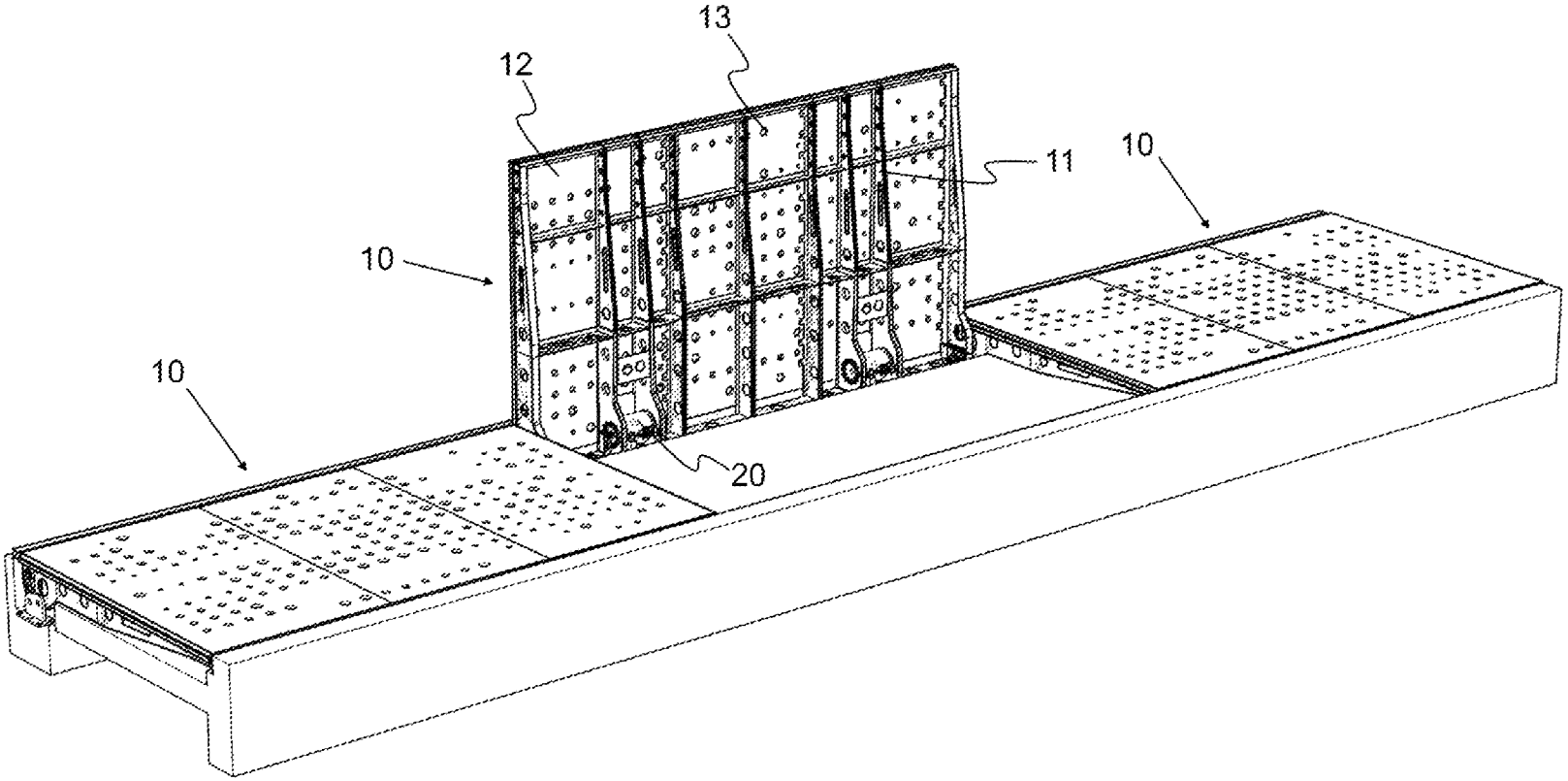
FIG. 2 is a perspective view showing cover of hatch control system of invention on ground.

The cover (10), which forms the main structure of the hatch control system, enables the creation of a barrier by raising from the ground to separate the bonded zone from unbonded zone in broad areas and especially in cruise ports. The cover (10) seen in FIG. 2 is generally made up of plates of concrete coating (12) on steel construction profiles (11). The hatch (10) is positioned parallel to the ground by being arranged side by side in contact with each other throughout the use area and can be opened and closed vertically by rising up from an edge surface on the ground. Illumination armatures can be connected into the hatch (10).

Glass holes (13) are placed on concrete coatings (12). The glass holes (13) provides the aesthetic appearance of the cover (10) raising upward from the ground and also provides reflection of light from illuminating armatures connected inside hatch (10).

Actuators (20) is provided in inner sections to provide opening and closing of the hatches (10) by raising upward on the ground. Power transmission to the actuators (20) is provided by means of the hydraulic power unit (30).

The hydraulic power unit (30) providing power transmission to actuators (20) by hydraulic pressure for opening and closing of the hatches (10), is controlled by command from the control center (40).

Security poles (50) are positioned around the hatch (10) in order to enable taking area security during opening-closing of the hatches (10) providing separation of customs and free of bonded zones from each other in broad zone accessible to public and particularly in cruise ports by means of raising thereof from ground. The security poles (50) are equipped with thermal or normal cameras and illumination units, and during the opening-closing of the hatches (10), ambient lighting is performed and the environment is monitored by the security units.

Working principle of hatch control system of the invention is as follow;

Before ships arrival, it is confirmed if there is any security problem by use of thermal and/or normal cameras on the security poles (50) and security staff in the quay field area also containing the covers (10) in close position.

In case of confirmation of no security risk in the zone, customs and port authorities give command to the hydraulic power unit (30) from the control center (40) to open the hatches. Hydraulic power unit (30) supplies hydraulic power transmission to actuators (20) by command from control center (40). The hatches (10) go upward from side surface on the ground and open vertically and form a barrier by means of actuators (20).

Following leave of ship, operational equipment is temporarily removed from the bonded zone and security staff conduct security of area finally by means of thermal and/or normal cameras.

In case of confirmation of no security risk in the zone, customs and port authorities command a hydraulic power unit (30) to close the hatches (10) from the control center (40). The hydraulic power unit (30) supplies hydraulic power transfer to the actuators (20) by command from the control center (40). The hatches (10) go downward from side surface on the ground by means of actuators (20) and close in a manner to become equal with ground.

The invention claimed is:

1. A pier hatch control system for separation of a bonded zone and an unbonded zone from each other in broad areas accessible to persons and in cruise ports, the pier hatch control system comprising:

a hatch having steel construction profiles and plates of concrete coating on the steel construction profiles, wherein said hatch is located in parallel to ground so as to raise upwardly from one surface on the ground such that said hatch creates a barrier between the bonded zone and the unbonded zone when opening upwardly on the ground;

an actuator connected to an interior of said hatch, said actuator cooperative with said hatch so as to rotate said hatch between an open position and a closed position;

a hydraulic power unit connected to said actuator so as to transmit power to said actuator; and a control center connected to said hydraulic power unit so as to transmit commands to said hydraulic power unit so as to rotate said hatch between the open position and the closed position.

2. The pier hatch control system of claim 1, wherein said hatch is connected to a surface in side-by-side relation in parallel to the ground.

3. The pier hatch control system of claim 1, further comprising:

glass holes located on the concrete coating; and armature lights connected inside said hatch and extending upwardly from the ground, said glass holes providing reflection of said armature lights.

4. The pier hatch control system of claim 1, further comprising:

a security pole positioned around said hatch, said security pole having a camera unit and an illumination unit thereon.

* * * * *